US008754283B2

(12) United States Patent
Lensa et al.

(10) Patent No.: US 8,754,283 B2
(45) Date of Patent: Jun. 17, 2014

(54) METHOD FOR PARTIALLY DECONTAMINATING RADIOACTIVE WASTE

(75) Inventors: Werner F. Lensa, Langerwehe (DE); Dirk Vulpius, Schleiden-Gemuend (DE); Hans-Juergen Steinmetz, Herzogenrath (DE); Kathrin Baginski, Dueren (DE); Rahim Nabbi, Juelich (DE)

(73) Assignee: Forschungszentrum Juelich GmbH, Juelich (DE)

( * ) Notice: Subject to any disclaimer, the term of this patent is extended or adjusted under 35 U.S.C. 154(b) by 13 days.

(21) Appl. No.: 13/808,214

(22) PCT Filed: Jul. 6, 2011

(86) PCT No.: PCT/DE2011/001414

§ 371 (c)(1), (2), (4) Date: Jan. 28, 2013

(87) PCT Pub. No.: WO2012/010145

PCT Pub. Date: Jan. 26, 2012

(65) Prior Publication Data

US 2013/0211172 A1 Aug. 15, 2013

(30) Foreign Application Priority Data

Jul. 12, 2010 (DE) ..... 10 2010 026 936

(51) Int. Cl.
*A62D 3/17* (2007.01)

(52) U.S. Cl.
USPC ..... 588/19; 588/306; 588/412

(58) Field of Classification Search
USPC ..... 588/19, 18, 1, 20, 306, 307, 308, 309, 588/310
See application file for complete search history.

(56) References Cited

FOREIGN PATENT DOCUMENTS

| | | |
|---|---|---|
| DE | 10 2004 036 631 | 3/2006 |
| WO | WO-2010/069290 | 6/2010 |

*Primary Examiner* — Edward Johnson
(74) *Attorney, Agent, or Firm* — Jordan and Hamburg LLP

(57) ABSTRACT

Methods for partially decontaminating radioactive waste wherein the waste is first mixed, or brought in contact, with at least one corrosive medium. Activation energy is then supplied to the corrosive medium, so that at least a portion of the radionuclide present in the waste is converted into at least one gaseous reaction product, or is dissolved, by hydrogen or hydrogen ions, oxygen or oxygen ions, and/or halogen (for example chlorine) or halogen ions from the corrosive medium. The aim is that of decontaminating a $^{12}C/^{13}C$-containing porous solid waste, which is contaminated with the $^{14}C$ radionuclide. For this purpose, $CO_2$ and/or hydrogen are applied as corrosive media to the waste, so that at least a portion of the waste is reacted to form at least one gaseous reaction product, wherein the process temperature is selected so that the $^{14}C$ radionuclide is enriched in the reaction product over $^{12}C/^{13}C$.

27 Claims, No Drawings

METHOD FOR PARTIALLY DECONTAMINATING RADIOACTIVE WASTE

The invention relates to methods for partially decontaminating radioactive waste.

BACKGROUND OF THE INVENTION

When used in nuclear reactors, graphite becomes contaminated with various radiotoxins, which are formed by the neutron activation of impurities contained in the graphite and/or by the neutron activation of the ambient atmosphere and/or by nuclear fission. These radiotoxins pose a particular problem for disposal if these are highly volatile, such as tritium ($^{3}H$) for example, are long-lived and volatile, such as $^{36}Cl$, or emit highly penetrating radiation, such as $^{60}Co$.

In addition, the carbon that is present in the graphite itself, having an atomic weight of 13, is activated to form radiocarbon ($^{14}C$). The capture cross-section for this reaction is only 0.0009 barns; however this should not be disregarded because of the significant concentration of $^{13}C$ of 1.11%. In addition, $^{13}C$ is generated by the neutron capture of $^{12}C$ (0.0034 barns) during exposure to radiation and thus also increasingly contributes to the formation of $^{14}C$. Furthermore, radiocarbon is generated by the neutron activation of nitrogen having an atomic mass of 14. At 99.64%, $^{14}N$ accounts for the majority of naturally occurring nitrogen. The cross-section for neutron capture with subsequent emission of a proton is 1.81 barns. In addition, radiocarbon forms via the oxygen isotope having an atomic mass of 17, which occurs naturally in an abundance of 0.039%, by way of neutron capture (0.235 barns) with subsequent emission of an alpha particle. In the neutron field, nitrogen and oxygen can be either a constituent of the reactor atmosphere or part of chemical bonds in reactor materials.

Radiocarbon differs from the stable isotopes of carbon only in the atomic mass thereof. Thus, this basically exhibits the same chemical behavior as the remaining isotopes of carbon. This is also reacted in biological processes as stable carbon and is not recognized as a foreign substance. The release thereof into the biosphere should therefore be avoided. This is also the reason why the threshold values for the final storage and for the potential release of radiocarbon are extremely stringent.

The radiotoxins, and here $^{14}C$ in particular, form only a fraction of several ppm (parts per million) in the overall mass of the graphite, however these are distributed substantially homogeneously over the entire volume thereof, so that the entire volume is considered radioactive waste, which in some countries is categorized as intermediate-level waste (ILW) or, due to the half life of 5730 years, as long-lived low-)evel waste (LLLW). Because final storage capacities are scarce and expensive, a need therefore exists for selectively removing radiotoxins from the graphite and concentrating the same in such an amount that the remaining graphite can either be categorized as low-level waste (LLW), or that even safe levels are measured and this can be reused.

A method is known from DE 10 2004 036 631 A1 for selectively removing radiocarbon by way of a chemical reaction at elevated temperatures. To this end, a gaseous corrosion medium is loaded against outer and inner surfaces of the graphite, wherein only a few percent of the graphite corrode, but a large portion of the radiocarbon is released. The method takes advantage of the realization that the majority of radiocarbon has become concentrated in the vicinity of the inner surfaces in the pore system of the graphite, since the radiocarbon is assumed to be essentially created by the activation of adsorbed nitrogen or oxygen in the pore system of the graphite, and thus to be oxidized with preference.

Improvement potential is considered to exist to the effect that a significant amount of radiocarbon and/or other radioactive isotopes remains in the waste after the method is carried out.

SUMMARY OF THE INVENTION

Therefore, the object of the invention is to improve the method known from the prior art to the effect that a larger portion of radionuclides present in the waste is reacted, while at the same time reacting the lowest possible amount of non-hazardous material.

DESCRIPTION OF THE PREFERRED EMBODIMENTS

Given the differing chemical or physical bonds of radionuclides as compared to natural isotopes, the methods according to the main claim and additional independent claim are based on the shared idea of deliberately influencing the reaction between the corrosive medium and the waste to be decontaminated by controlling the reaction parameters, and more particularly the supply of energy, so as to remove the highest possible portion of radionuclides from the waste matrix. Because of the particular difficulty that the removal of radiocarbon from carbon-based waste poses, the methods will be described in particular detail by way of the example of the decontamination of nuclear graphite (almost completely graphitized high-purity graphite) and carbon brick (incompletely graphitized technical carbon matrix).

The inventors have recognized why certain radioactive isotopes that are generated by neutron activation have different chemical and physical bonding characteristics than the natural isotopes. The decisive factor is the recoil energy that is generated during the neutron activation as compared to the intensity of the originally present chemical bonds of the activated atom. If the recoil energy is significantly greater than the binding energy, for example in the crystal lattice, the $^{14}C$ atoms resulting from activation of $^{13}C$, for example, are also ejected from the crystal lattice.

Previously, the expert community was under the assumption that a portion of $^{14}C$ is firmly bound in the crystal lattice of the graphite and not accessible to a selective reaction from contact with the corrosive medium. The inventors have now recognized that all processes, by way of which $^{14}C$ is created when graphite is used in a nuclear reactor, are subject to such high recoil that even a $^{13}C$ atom, which originally is regularly bound in the crystal lattice, is separated from the crystal structure. As a result, a larger portion of $^{14}C$ than previously assumed becomes accessible to the reaction by the corrosive medium. According to the findings made by the inventors, this portion was not reacted because the corrosive medium did not reach it. Additionally, the reaction with the corrosive medium did not take place homogeneously in the entire volume of graphite to be decontaminated, but instead the outer and inner surfaces were preferred, from where the corrosive medium was loaded. Radiocarbon located deeper in the pore system, or in the interstitial regions of the graphite, was not affected.

By controlling the reaction parameters according to the invention, and more particularly the energy that is supplied to the reaction, the temperature, the selection, and concentration of the reactants, the corrosive medium is not consumed on the macroscopic outer surface of the waste, but penetrates deeper into the pore system of the graphite and reacts a larger portion of radionuclides deposited there on the inner surfaces to form gaseous reaction products. In addition, the reaction rate is reduced to the minimum necessary so as to react the largest possible portion of the radionuclide, without also reacting the non-hazardous portion of the waste. The methods according to the main claim and the additional independent claim disclose measures that can be used, either individually or in combination with each other, to work toward this objective.

The reaction of the corrosive medium with the radionuclide can be in particular a redox reaction, in which the corrosive medium is reduced and the radionuclide is oxidized.

The object of the method according to the main claim is that of decontaminating solid waste that is contaminated with at least one radionuclide. To this end, the waste is first mixed, or brought in contact, with at least one corrosive medium. Activation energy is then supplied to the corrosive medium, so that at least a portion of the radionuclide present in the waste is converted into at least one gaseous reaction product, or is dissolved, by hydrogen or hydrogen ions, oxygen or oxygen ions, and/or a halogen (for example chlorine) or halogen ions from the corrosive medium. A mixture of different corrosive media can also be explicitly loaded.

The hydrogen, hydrogen ions, oxygen, oxygen ions, halogen, and/or halogen ions can be loaded in this form. For example, these can be loaded in low concentrations in an inert gas flow. However, these can also be formed from the corrosive medium when the activation energy is supplied. For example, a peroxide, water vapor, an acid, carbon dioxide, a complexing agent, a halogen compound, hydrocarbon, halogenated hydrocarbon, and/or another reagent that can be pyrolyzed and/or dehydrated as the corrosive medium can be selected.

The hydrogen, hydrogen ions, oxygen, oxygen ions, halogen, and/or halogen ions can react with the radionuclide especially in the nascent state. These are especially reactive in this state.

It was recognized that this method, in several respects, allows for a distinction to be made between the radionuclide and the remaining waste, and thus for the radionuclide to be selectively separated from the remaining waste. The goal of decontamination is always to concentrate the radionuclide as much as possible and withdraw as little non-hazardous material as possible from the waste.

In many cases, the radionuclide is concentrated at, on, in, or in the vicinity of outer and inner surfaces of the waste. These surfaces can especially be the inner surfaces of pore systems of the waste. By loading the corrosive medium on a large part of these surfaces before the activation energy is supplied, the corrosive medium reacts simultaneously with this large part of the surface after the activation energy has been supplied. As a result, preference is given to the radionuclide in being attacked at the beginning of the reaction, and the remaining substance of the waste is spared. A large portion of the total radionuclide contamination that is present can thus be removed, using only one step, and conditioned for separate final storage.

In many cases, the radionuclide is additionally bound in the waste with a lower binding energy than other materials, which should not be removed. This binding energy can be of a chemical or physical nature. If, for example, the radionuclide was created in situ by a nuclear reaction, or if this was exposed at the site thereof in the waste to neutron radiation, the bond of the radionuclide to the waste may have been selectively changed as compared to the bond of the remaining materials in the waste among each other, in particular this may have been weakened. The corrosive medium and/or the activation energy can now be selected in a targeted manner so that these changed bonds with the waste are precisely dissolved. The radionuclide is then selectively removed, while the remaining substance of the waste is substantially spared. In the extreme case, the radionuclide is present in gaseous form trapped in closed pores, which is to say not bound at all to the remaining substance of the waste, and can readily escape during grinding, and, optionally, during heating of the waste.

In a particularly advantageous embodiment of the invention, waste is selected that has a matrix made of a non-radioactive base material, in which the radionuclide is embedded. For example, the radionuclide can have been first embedded at the site thereof in the matrix in a non-radioactive form and activated thereafter. However, this can also have been activated at a different site and thereafter only have been adsorbed on the matrix, or this can have been embedded in the matrix by way of diffusion. In each of these cases, the radionuclide will be bound differently to the matrix than the constituents of the matrix among each other.

If the radionuclide is bound in this matrix with a lower binding energy, or in a different type of bond or chemical compound, than the base material itself, this will be attacked and reacted, before the base material is attacked, when the activation energy is supplied. Chemically, the radionuclide and the base material can be very similar; these can even be isotopes of the same element. The difference between the radionuclide and the base material that is important for selectively removing the radionuclide is thus not present a priori as a difference between the materials, but is induced in the materials, for example due to differing histories of nuclear reactions, in the form of differing binding conditions.

This is the case in particular in a further particularly advantageous embodiment of the invention, in which at least one radionuclide, with which the waste is contaminated, was formed by a nuclear reaction, in particular nuclear fission or neutron activation. Nuclear reactions were found to be subject to a recoil energy, which can exceed the binding energies in crystals by several orders of magnitude. When a radionuclide is formed by a nuclear reaction with high recoil, this is broken out of existing chemical bonds, and more particularly this is ionized, and is then bound differently in the matrix, in particular with a lower binding energy.

This is especially the case when the nuclear reaction took place in the material of the waste. This includes both the case in which a non-radioactive element was incorporated in the waste from the start and was activated there, and the case in which an activatable foreign substance penetrated into the waste and was activated there. Even if the matrix is very stable per se, the radionuclide is then bound more weakly in this matrix. When the activation energy is supplied, which can be done gradually, the radionuclide will be attacked first, while the energy is not sufficient to attack the stable matrix.

This is particularly advantageous in a further embodiment of the invention. In this embodiment, the waste that is selected contains a further isotope of the same element, in addition to the radionuclide. Using chemical methods according to the prior art, removing the radionuclide in such cases was very difficult because this reacts in general with the same corrosive media as the base material. The inventors have now found that the respective activation energy that is required for this reaction constitutes a difference between the radionuclide and the base material. This difference is utilized according to the invention in order to at least partially separate the radionuclide from the base material.

The method can not only be employed to condition waste prior to final storage, but also as a work step in the reprocessing of spent nuclear fuels. Various isotopes of one and the same element, which were created by differing histories of nuclear reactions, can be separated from each other using the method according to the invention. This takes advantage of the fact that the differing histories manifest themselves in differing binding conditions of the individual isotopes in the waste. According to the prior art, spent fuel elements are, for example, completely dissolved in acids and from the liquid phase, the various chemical elements are separated from each other by specific ion exchange or complexation reactions. Thus separating individual isotopes from each other is no longer possible. However, this would be desirable for conditioning the residual waste for final storage. The solution of the fuel element in the acid, for example, contains three different isotopes of cesium: in addition to a stable isotope, there is $^{134}$Cs having a half life of 2.06 years, $^{137}$Cs having a half life of 30.0 years, and $^{135}$Cs having a half life of two million years. Because of the shorter half life, $^{134}$Cs develops considerably more heat per unit mass and thus requires different intermediate or final storage conditions than $^{137}$Cs or $^{135}$Cs.

A portion of the $^{134}$Cs has been created by neutron activation in the fuel element and, as a result of the lower recoil, is bound differently in the matrix of the nuclear fuel than the $^{137}$Cs that was created by way of nuclear fission and has high recoil energy. The method according to the invention can now be used, for example, to extract this fraction of $^{134}$Cs from the still solid, and optionally already comminuted, fuel element before this is dissolved.

In a further particularly advantageous embodiment of the invention, porous waste is selected, which can, in particular, be additionally granulated and/or pulverized. By mixing the waste with the corrosive medium in accordance with the invention separately before the onset of the reaction in terms of time, the corrosive medium is assured to reach a larger portion of the total inner surfaces of pore systems that are present in the waste than according to the present prior art. If the waste is porous, the active surface thereof that is accessible to the corrosive medium is already sufficiently large when this is present in the form of large particles, or even as a solid block. The lower the porosity thereof, the smaller this must be ground to achieve a predetermined accessible active surface.

At the same time, the hydrogen, hydrogen ion, oxygen, oxygen ion, halogen, or halogen ion is not released until this is in the direct vicinity of the outer surfaces of particles or inner surfaces of a present pore system. These substances can thus still be nascent at the time of interacting with the waste. These will then exhibit higher reactivity. If oxygen is released, the pore system is opened further by the incipient oxidation, so that the reaction can also penetrate into the part of the pore system that was previously still closed. As an alternative, the reacting substances can also be incorporated between the crystal lattice planes by way of intercalation so as to attack the radionuclides present there.

For this purpose, it is particularly advantageous if the corrosive medium is inert with respect to the base material before the activation energy is supplied.

In a particularly advantageous embodiment of the invention, waste containing $^{12}$C and/or $^{13}$C is selected. The radionuclide with which such waste is often contaminated is $^{14}$C. The inventors have found that a carbon matrix contains $^{13}$C from two different sources: approximately 1.1% of the total $^{13}$C that is present is of natural origin. The remainder has been formed by way of conversion from $^{12}$C. This conversion is a nuclear reaction and therefore likewise associated with high recoil. Thus, the $^{13}$C converted from $^{12}$C is bound more weakly to the carbon matrix from the start than the natural $^{13}$C. As a result, the $^{14}$C activated from the converted $^{13}$C is also bound more weakly than the $^{14}$C activated from natural $^{13}$C. This contributes to the fact that the overall contamination with $^{14}$C is bound more weakly to the carbon matrix than the remaining carbon atoms are bound in the matrix among each other.

According to the prior art, particular difficulties were encountered with the decontamination of carbon-containing waste because the stable carbon having an atomic mass of 12 ($^{12}$C with 98.89% in natural abundance), the likewise stable carbon having an atomic mass of 13 ($^{13}$C with 1.11% in natural abundance) and the radioactive carbon (radiocarbon) that is generated by neutrons or cosmic radiation and has an atomic mass of 14 ($^{14}$C) behave equally in terms of chemistry according to common knowledge.

The inventors have found that the radionuclide is not necessarily present in solid form in porous solid waste. In closed pores, for example, a radionuclide can also be formed in situ in gaseous form by way of nuclear reactions. This is then trapped in the pores and diffuses very slowly to the outside, depending on how tightly the pores are closed. Such waste poses the additional problem during handling and final storage that this continually emits small amounts of gaseous radionuclide. For example, the pore systems contain graphitic waste, such as graphite, reactor graphite, or carbon brick for example, in addition to open and closed pores. Under neutron bombardment, $^{14}$C forms in these closed pores. If the pore system has been produced with trapping of air, both oxygen and nitrogen have been trapped in the closed pores. $^{14}$C can react with the oxygen to form CO and $CO_2$. $^{14}$C can react with the nitrogen to form, for example, cyanogen, $(CN)_2$, and/or paracyanogen, $(CN)_x$.

Reactions that do not normally take place at room temperature because of a lack of activation energy can take place as radiation-induced chemical reactions, which are not nuclear reactions. Because of the irradiation with neutron and/or gamma radiation, free radicals, such as nascent oxygen and/or nitrogen, for example, are formed continually. The irradiation thus indirectly provides the activation energy for the reaction. Chemical compounds can even possibly be created, which would not be formed at all without radiation.

For a compound that has been created under radiation to be selectively reacted, it is not necessarily required that this is bound with lower binding energy in the matrix of the base material than the atoms or molecules of the matrix are bound among each other. It suffices if the compound differs chemically from the base material. This can then be selectively removed using a reagent that does not attack the base material.

The fact that a portion of the $^{14}$C in graphite is trapped in gaseous compounds in closed pores follows from the result of an experiment, in which two graphite samples having an identical irradiation history were ground into differing particle sizes and subsequently analyzed for the contents thereof of $^{14}$C by combusting and analyzing the resulting $CO_2$. If the sample was ground to such fineness that the pore system was completely destroyed, the analysis showed considerably less $^{14}$C. A portion of the $^{14}$C had escaped even before the combustion in form of gaseous contaminants due to the fine grinding to the micrometer range.

The gaseous contaminant thus formed in closed pores can now advantageously be better covered by the method according to the invention than according to the prior art. Because the corrosive medium is spread better throughout the pore system, this advantageously also reaches locations in which the closed pores open as the reaction progresses. The escaping gaseous contaminant, which contains the radionuclide, is then directly reacted by the corrosive medium.

Because the hydrogen, hydrogen ions, oxygen, oxygen ions, halogen, and/or halogen ions in total reach a greater portion of the inner surfaces of the pore system than is possible according to the prior art, and additionally are, in part, nascent there, the selective reactivity as a whole is advantageously increased. The reaction can thus take place at a lower temperature and can be better controlled with regard to a selective removal of $^{14}C$, for example. At the same time, the reactivity with respect to non-hazardous materials in the waste is contained, so that only a small amount of non-hazardous material is removed. The waste is in particular not entirely reacted into a reaction product. Instead, the largest mass fraction of the waste, which is generally at least 95%, remains in solid form. This effect can also be achieved by using UV or gamma radiation by way of radiolysis of the corrosive medium, forming radicals.

For example, activity measurements can be used to monitor the ratio of reacted $^{14}C$ to reacted $^{12}C/^{13}C$. At the beginning of the reaction, essentially $^{14}C$ is reacted, which is bound only loosely in the waste according to the findings made by the inventors. As the amount of weakly bound $^{14}C$ becomes exhausted, the rate at which this is reacted decreases asymptotically, while the rate at which the $^{12}C/^{13}C$ is reacted remains constant. However, the method precisely aims to separate $^{14}C$ from $^{12}C/^{3}C$ so that it is necessary to provide final storage only for $^{14}C$, or to be able to separate the same as a valuable product and reuse $^{12}C/^{13}C$. The reaction of carbon can thus advantageously be stopped when, depending on the procedure, no $^{14}C$, or no increase in the concentration of $^{14}C$, is detected any longer in the reaction product.

In a particularly advantageous embodiment of the invention, waste that is present in the form of solid pieces, granules, or powder is selected. This waste can be mixed particularly well with a corrosive medium that is present in the form of solid pieces, granules, or powder. Thus, a corrosive medium that is present in the form of solid pieces, granules, or powder is advantageously selected.

The hydrogen, hydrogen ions, oxygen, oxygen ions, halogen, and/or halogen ions are released from the solid corrosive medium by way of thermal decomposition. In addition, water (for example in the form of water of crystallization or structured water) and CO9 (for example from carbonates) can be released by way of thermal decomposition. The waste can be present from the start in the form of solid pieces or granules, or can be a larger block, which is comminuted into pieces or particles before the mixing process. The particles advantageously have a size of several millimeters to several hundred micrometers, at which the active surface is sufficiently large, while preserving the internal pore structure, for a reaction rate that is acceptable from an economic perspective, or so small that the pore system is opened, which can be achieved with particle sizes around several micrometers. Because the reaction rate, in turn, is dependent on the temperature, the useful particle size is also temperature-dependent. The lower the reaction temperature is, the larger the particles can be.

The corrosive medium is advantageously selected from at least one binary metal oxide, sulfate, nitrate, hydroxide, carbonate, hydride, and/or halogen succinimide. These corrosive media release oxygen, water vapor, carbon dioxide, sulfur compounds, or nitrogen compounds when heated, for example.

For example, a binary metal oxide can assume a structure that corresponds to a stoichiometry with less oxygen. The excess oxygen can then be given off as nascent oxygen. For example, CuO reacts in the temperature range of 600 to 800° C. to form $Cu_2O$, wherein nascent oxygen is released for the selective reaction with $^{14}C$.

The gaseous reaction product is not directly a sulfate. However, in the particularly advantageous embodiment of the invention, in which graphite, reactor graphite, or carbon brick is selected as the waste, sulfate ions are suitable foreign ions, which can advantageously be intercalated between the crystal lattice planes of the graphite.

In a particularly advantageous embodiment of the invention, atoms, molecules, or ions are intercalated between the crystal lattice planes of the graphite. These atoms, molecules, or ions can originate, in particular, from at least one corrosive medium.

The graphite is split further by the formation of intercalation compounds. This allows extremely large surfaces for the decontamination of irradiated graphite to be produced. In particular, radionuclides located between the crystal planes can thus be removed. The intercalation process can be carried out as a separate pretreatment stage, during which a large number of radioactive isotopes is already removed (for example metallic radioisotopes). However, the process can also be combined by adding liquid oxidizing agents from the start of the reaction or by admixing with time offset. It is possible in particular to open closed pores during the intercalation and to make gaseous contaminants trapped in these pores accessible to a reaction, or to remove them directly from the pore system or the interstitial region.

Using a nitrate as the corrosive agent fulfills a dual function. This can release nascent oxygen and be converted into a nitrite. The nascent oxygen is then available for the selective oxidation of $^{14}C$. Similarly to sulfate ions, nitrate ions are also suitable for intercalation between the crystal lattice planes of the graphite. As a result of the intercalation, a wedge is driven between the crystal lattice planes, separating them from each other. As a result, on both crystal lattice planes, the areas with which these previously abutted each other become accessible for the corrosive medium. It is possible then in particular to react radionuclides that have deposited between the lattice planes by way of the corrosive medium.

The intercalation between the crystal lattice planes of the graphite can also be carried out as a separate pretreatment stage using a first corrosive medium, before the graphite is mixed with a second corrosive medium, to which the activation energy is then supplied.

At increased temperatures, a hydroxide, serving as the corrosive medium, can give off water vapor. This water vapor reacts with $^{14}C$ to form gaseous reaction products, such as hydrogen and carbon monoxide. At increased temperatures, a carbonate, serving as the corrosive medium, can give off $CO_2$. The method according to the additional independent claim uses $CO_2$ as the corrosive medium.

At increased temperatures, a hydride, serving as the corrosive medium, can give off hydrogen. This hydrogen can react with $^{14}C$ to form methane ($^{14}CH_4$), especially via a redox reaction. The hydrogen is nascent, so that the reaction already takes place at a lower temperature than when using molecular hydrogen, and additionally this prefers $^{14}C$ over $^{12}C$ as the reactant.

At increased temperatures, a halogen succinimide, serving as the corrosive medium, can give off the halogen, for example chlorine. This can then react with metallic radionuclides to form volatile metal chlorides. Chlorine, for example, can convert $^{60}Co$, $^{90}Sr$, and $^{137}Cs$. Compared to using halogen directly as the corrosive medium, halogen succinimide has the advantage that, in the state in which this is initially still inert with respect to the carbon, this can be better mixed with the waste. In addition, halogen succinimide is less dangerous in terms of handling than the halogen contained therein in the gaseous state.

In a further advantageous embodiment of the invention, a liquid corrosive medium is selected. In particular when this is inert with respect to the base material (such as carbon, for example) before the activation energy is supplied, this can infiltrate the pore system of the waste. Once the pore system is filled with the liquid corrosive medium, the activation energy is supplied. Radionuclides are then reacted on all inner surfaces of the pore system that are in contact with the corrosive medium.

Advantageously, the corrosive medium that is selected is water, a peroxide, an acid, a lye, a complexing agent, and/or an electrolyte.

Metallic radionuclides and $^{36}Cl$ are in part present in the form of salts. These can be dissolved in water as the corrosive medium without a chemical reaction, and in particular without changing the oxidation numbers thereof. If gamma radiation is present, water as the corrosive medium can additionally be radiolyzed, forming free radicals. These radicals can then attack further radionuclides, such as $^{14}C$, for example, by way of oxidative action.

A peroxide can be $H_2O_2$, for example. This can release nascent oxygen, which then reacts the radionuclides, even with a comparatively small increase in temperature. However, this can also draw the activation energy thereof from the ambient temperature if a suitable catalyst is present at the site where the nascent oxygen is to be released, wherein the catalyst pushes the activation energy to below the thermal energy of the ambient temperature. By thus occupying the pore system of the waste with catalyst material, and subsequently infiltrating the peroxide, it is assured that the waste is first mixed from the inside with the peroxide, and the radionuclides are then reacted by the nascent oxygen.

Acids act as corrosive media in two respects: first, as a substance that supplies hydrogen ions and is able to dissolve metals and metal ions, and second, as an oxidizingly acting substance, which is able to attack oxidizable substances such as graphite by the transfer of electrons (redox reaction). If the temperature is adjusted favorably (60 to 90° C.) and when mixed thoroughly with the graphite to be treated, concentrated sulfuric acid or nitric acid, for example, acts as a selective corrosive medium for $^{14}C$ in accordance with the following reaction equations:

$$^{14}C+2\ H_2SO_4 \rightarrow {}^{14}CO_2+2\ SO_2+2\ H_2O$$

$$^{14}C+4\ HNO_3 \rightarrow {}^{14}CO_2+4\ NO_2+2\ H_2O$$

If the corrosive medium is an electrolyte, the activation energy for the reaction of the radionuclides can advantageously be supplied by applying a direct current or by an alternating magnetic field. It was found that the majority of all radioactive isotopes that can occur in graphitic waste can be removed by way of electrolysis, in which the waste forms the anode. The reason for this lies in the chemical properties of these radioactive isotopes, which are present either in ionically ($^{36}Cl$, metallic radioisotopes) or covalently ($^{3}H$, $^{14}C$) bound form, wherein the covalently bound radioisotopes can be oxidized particularly easily. The ionic radioactive isotopes are expelled from the graphite matrix by applying a positive (for positively charged ions, for example $Co^{2+}$, $Sr^{2+}$, $Cs^{+}$) or negative direct current (for negatively charged ions, for example Cr), wherein the process is started advantageously with a negative direct current. The reason for this is that highly reactive (atomic) oxygen is created when a positive direct current is applied to the electrode (anode), the oxygen causing the graphite to swell and flake in layers due to the formation of graphite oxide (a compound having a graphite structure, but alternating oxygen-containing functional groups). However, this process expels not only the positively charged metal ions, but also oxidizes and releases the covalently bound radioactive isotopes ($^{3}H$, $^{14}C$). $^{3}H$ remains in solution, while $^{14}C$ escapes as CO. At the same time, the surface of the waste that is exposed to the attack of the electrolyte increases with every flaking step.

If an alternating magnetic field is applied, the action of the currents induced thereby corresponds to the alternate application of positive and negative direct currents with simultaneous heating of the waste.

It is possible in particular to also open closed pore systems so that gaseous contaminants trapped therein can be made accessible to a reaction or removed directly from the pore system. For example, diluted (approximately 5%) nitric acid or perchloric acid is suitable as the electrolyte solution for this method. Before a water- or hydrogen-containing electrolyte is used, advantageously possible contamination of the waste with tritium is removed in a different manner, for example, by previously annealing the waste. This prevents the electrolyte from becoming contaminated with the tritium and then requiring proper disposal thereof. Metallic radioisotopes that have gone into solution can easily be chemically removed from the electrolyte by way of precipitation, ion exchange, or complexation. The separated radioactive isotopes can be disposed of as radioactive waste or particularly advantageously recirculated as valuable products to research and industry for commercial usage.

Reagents can also be added to a liquid corrosive medium, which not only act catalytically, but also transfer hardly soluble, and in particular metallic, contaminations into the liquid or gaseous phase.

The activation energy can be supplied in form of heat, UV rays, or gamma rays to all corrosive media, in which the reaction with the waste can be started by an increase in the temperature, For example, warming can be carried out by heating, irradiating with microwaves, or by an alternating magnetic field. The irradiating with microwaves has the advantage that the waste mixed with the corrosive medium is warmed from the inside. Thus, precisely those regions in which the residual contamination is particularly high according to the present prior art, are preferably warmed and thus decontaminated. The irradiation with gamma rays can deeply penetrate the waste and create reactive radiolysis products. Gamma rays and UV break direct bonds in the corrosive medium and generate free radicals, which react with the radionuclide, potentially in the nascent state. In the case of gamma rays, this is referred to as radiolysis.

The temperature that is advantageous or required to start the reaction depends on the activation energy of the corrosive medium that is used in the specific case. The thermal energy $k_BT$ ($k_B$: Boltzmann constant) corresponding to the temperature T must at least be equivalent to this activation energy. The activation energy can be lowered by a catalyst for this purpose.

Advantageously, a temperature between 100 and 1100° C., preferably between 200 and 750° C., and still more preferably between 200 and 500° C. is selected. In this temperature range, the reaction takes place at a practicable reaction rate, depending on the type of the corrosive medium. The method works particularly well with chemically weak corrosive media in the range between 200 and 750° C. These weak corrosive media can advantageously be selected in particular so that these first penetrate deeply into a pore system and then react. The method works particularly well with chemically strong corrosive media in the range between 200 and 500° C. These temperatures can also be easily controlled by technology.

The aim of the method according to the additional independent claim is that of decontaminating a $^{12}C/^{13}C$-containing porous solid waste, which is contaminated with the $^{14}C$ radionuclide. For this purpose, $CO_2$ and/or hydrogen are applied as corrosive media to the waste, so that at least a portion of the waste is reacted to form at least one gaseous reaction product, wherein the process temperature is selected so that the $^{14}C$ radionuclide is enriched in the reaction product over $^{12}C/^{13}C$. Typically, in total only a few percent by weight of the waste is reacted, however 80% and more of the total $^{14}C$ contamination that is present is removed. Hydrogen has the advantage that this is the smallest molecule of all and therefore the easiest to transport through a widely branched pore system.

The reaction of $CO_2$ and hydrogen as the corrosive media with carbon is an endothermic ($CO_2$) or weakly exothermic (hydrogen) reaction. At temperatures around 1000° C. $CO_2$ penetrates deeply into the pore system of the waste and converts preferably the more reactive $^{14}C$ into CO by way of the Boudouard reaction ($CO_2C$->2 CO; $\Delta H$=+172.47 kJ/mol). At these temperatures, hydrogen as the corrosive medium forms methane with carbon (C+2 $H_2$->$CH_4$; $\Delta H$=−74.77 kJ/mol). Carbon bound weakly in the pore system and/or in the crystal interstitial region reacts considerably earlier with the $CO_2$ or the hydrogen than carbon that is bound firmly in the crystal lattice in lattice sites. For the selective removal of $^{14}C$ from the waste, the inventors, as in the method according to the main claim, take advantage of the finding that the $^{14}C$ is primarily bound loosely in the pore system and/or in the crystal interstitial region as a result of the recoil forces that act during the activation thereof. The endothermic or weakly exothermic reaction can be controlled in each case by way of the process temperature, so that preferably $^{14}C$ is reacted. An activity measurement can be used to determine the ratio at which $^{14}C$ is enriched in the reaction product as compared to $^{12}C/^{13}C$. By being given the instruction to control the selective removal of $^{14}C$ by way of the process temperature, a person skilled in the art thus receives sufficient information to achieve this aim without undue experimentation.

At the beginning of the reaction, essentially $^{14}C$ is reacted, which according to the findings made by the inventors is bound more weakly in the waste than the stable isotopes. As the amount of relatively weakly bound $^{14}C$ becomes exhausted, the rate at which this is reacted decreases asymptotically, while the rate at which the $^{12}C/^{13}C$ is reacted remains constant, However, the aim of the method is precisely to separate $^{14}C$ from $^{12}C/^{13}C$ so as to have to provide final storage only for a small amount of $^{14}C$ (containing some fractions of likewise released $^{12}C/^{13}C$) or be able to utilize this as a valuable product. At the same time, the considerably larger fraction, in terms of volume, of the $^{12}C/^{13}C$ can be otherwise further utilized or be safely transported to final storage under facilitated conditions. The reaction of carbon can thus advantageously be stopped when, depending on the procedure, no $^{14}C$, or no increase in the concentration of $^{14}C$, is detected any longer in the reaction product.

it is possible in particular to also use $CO_2$ and hydrogen as corrosive media in the method according to the main claim, For this purpose, the graphite can first be mixed with these media, before the temperature is then increased to a range in which the endothermic or weakly exothermic reaction takes place. In the Boudouard reaction, a respective oxygen atom from the corrosive medium, this being $CO_2$, reacts a carbon atom from the waste.

Especially when used as the corrosive medium, $CO_2$ has the advantage over the use of water vapor, which has already been described in the prior art, in that the typically significant tritium activities in the irradiated graphite do not mix with the water (or water vapor) by way of exchange reactions and lead to a further problem in terms of disposal.

For example, $CO_2$ can be loaded in gaseous form as a finished product. However, this can also be formed directly in the pore system by adding oxygen at suitable process parameters. By reacting a first carbon atom, an $O_2$ molecule is then converted in a first step into $CO_2$, which is converted in a second step into 2 CO by reacting a further carbon atom.

The decontamination of graphitic waste with carbon dioxide can be carried out in a continuous or discontinuous gas flow. The principle of the method is the same in each case: only a very small amount of carbon dioxide is required because the radiocarbon that is to be released and is present in the graphite occurs only in very low chemical concentrations. Decisive factors for employing the method include the technical complexity and the mass throughput.

The CO reaction product enriched with the $^{14}C$ should not be separated from the radioactive $CO_2$. The $CO_2$ is advantageously separated from the reaction product by way of freezing out (physical pathway) or by washing out with a lye (chemical pathway). The physical pathway employs the differing boiling and freezing temperatures of carbon monoxide (−191.6° C. and −205.1° C., respectively) and of carbon dioxide (sublimation point: −78.5° C.). Carbon dioxide can thus be separated from the reaction gas by way of freezing and recirculated to the reaction process. Using the chemical pathway, the two gases can be separated from each other by conducting the reaction gas through sodium hydroxide, which absorbs the carbon dioxide and converts this into carbonate. Both pathways thus result in chemically pure carbon monoxide, which is enriched to a higher degree with $^{14}C$ and can be further processed (for example, for final storage or for the commercial use of $^{14}C$).

The methods are advantageously carried out in a rotating reaction vessel or by using mixers, so as to homogeneously decontaminate the entire waste volume that is present. Another option is that of using fluidized bed reactors, if the waste to be treated is sufficiently ground and inert carrier gases, which are provided with reactive gas additives, are employed. In addition, at least one reactive medium can be applied to the waste so as to convert low-volatile contaminations into volatile ones (for example into metal chlorides). This reactive medium can, for example, be an oxidizing medium or a halogen. It is also possible to consecutively admix several reactive media at different temperatures.

The waste that is selected is advantageously graphite, reactor graphite, carbon brick, or waste that contains one or more of these materials.

Advantageously, waste having a porosity of at least 5%, and preferably between 10 and 25%, is selected. The microporosity of graphite used in nuclear technology ranges between 10 and 20%. Porosity in the claimed range allows even liquid corrosive media to penetrate deeply into the interior of the waste and thus results in a very homogeneous incorporation and release of the corrosive medium.

The methods are particularly suited to advantageously convert $^{14}C$ and/or a metallic radionuclide into at least one gaseous reaction product or to dissolve this. These constitute the radionuclides that pose a particular problem in terms of disposal.

Advantageously, a catalyst is loaded to the inner surfaces of the pore system in the waste, wherein the catalyst lowers the required activation energy for the reaction of the corrosive medium with the radionuclide. If the waste is mixed in the solid phase with the corrosive medium, the catalyst can likewise be admixed in the solid phase. As an alternative, or in combination therewith, the waste can be impregnated with the catalyst before this is mixed with the corrosive medium. Admixtures of 0.16% $CsNO_3$, for example, have already produced clear effects in earlier experiments.

The catalyst allows for lower reaction temperatures and accelerates the reaction of the radionuclide by the corrosive medium as compared to non-catalyzed processes. A lower reaction temperature allows better technical control of the process and thus is also more economical because of the reduced energy expenditure. At lower reaction temperatures, the corrosive medium, or the hydrogen, hydrogen ions, oxygen, oxygen ions, halogen, and/or halogen ions from the corrosive medium additionally reach a greater portion of the inner surfaces of the pore system because the reactivity of these substances with respect to the carbon of the graphite is not as high, so that only outer burn-up of the graphite would occur. A larger portion of the only weakly bound $^{14}C$ would thus be removed.

The catalytic action of cesium nitrate ($CsNO_3$) is prominent, which results in a notable reaction increase already at 350° C. when treating graphite with oxygen. The catalyst attains the best action if this is introduced deeply into the pore system of the graphite by way of impregnation.

An added catalyst should either be removed again after the reaction or at least not be disadvantageous for storing the residual waste.

The waste is advantageously annealed at temperatures above 1000° C., and preferably between 1300 and 1500° C., before the corrosive medium is added. This removes and selectively releases volatile radionuclides, such as tritium, for example, due to pyrolysis of the tritium-based hydrocarbons. Covalent bonds, by way of which tritium and carbon are bound to hydrocarbon, are then split. This results in gaseous hydrogen and solid carbon. This reaction can be employed for the purpose of releasing tritium from graphite. To this end, the waste (graphite) is heated in an inert gas atmosphere (for example $N_2$ or Ar) or under a vacuum. The reaction products can be supplied to additional processing, conditioning, or disposal steps. Further processing of tritium as a valuable product is also conceivable.

The graphite that is obtained after withdrawing the reaction product or products can be either dried and further processed in the moist state, or solidified with cement or bentonite and disposed of (final storage). In a further advantageous embodiment of the invention, this is embedded in a geopolymer. This is an alumosilicate having a polymer structure. A vitreous product is thus obtained using an aqueous pathway, which can be further processed or transported to final storage.

In a particularly advantageous embodiment of the invention, the waste is at least partially reacted with zirconium to form zirconium carbide after withdrawing the reaction product or products. Zirconium forms zirconium carbide with carbon at 1900° C. Graphitic radioactive waste can be processed to obtain zirconium carbide, for example, together with zirconium-containing radioactive waste that occurs in large quantities during the reprocessing of fuel elements of light water reactors (for example fuel rod cladding tubes made of zirconium alloy). After the graphite has been decontaminated using the methods described above and the zirconium alloy waste has been decontaminated (the radioactively contaminated superficial oxide layer has been removed), the two waste materials can be used to either obtain a new, chemically extremely resistant (inert) waste product having only low radioactivity, or the resulting compound can be reused as a valuable product. Because of the high leach and corrosion resistance, the zirconium carbide can also be used as a matrix for radioactive waste and for the radioactive isotopes remaining in the zirconium carbide. It appears to be advantageous to remove the volatile radionuclides during the heating phase of the zirconium/graphite mixture by using the aforementioned methods for removing radioisotopes from graphite, or by reducing oxides adhering to the zirconium, until the exothermic reaction for the reaction to form zirconium carbide sets in. All selective decontamination steps disclosed herein can be employed before the synthesis of carbides in order to first selectively remove specific radionuclides. These will then not be a constituent of the carbide intended for final storage.

More recent analyses with regard to the activation process of $^{13}C$ have shown that high-energy gamma quanta are emitted and the $^{14}C$ atom that is created thereby experiences recoil of more than 2 kiloelectron volts (keV), while this was previously incorporated in the graphite lattice with far lower binding energies (a few electron volts). The consequence is thus (contrary to the prevailing opinion held until now in the expert community) that the radiocarbon created from $^{13}C$ also leaves the lattice site thereof. If the radiocarbon is generated from nitrogen, the recoil is in the range of 40 keV. Therefore, the $^{14}C$ atom thus created also detaches from the originally present chemical bonds.

The inventors simulated this effect by bombarding graphite with $^{14}N$ atoms that were accelerated to 40 keV and thus implanted $^{14}N$ in the graphite. The results show a penetration depth of approximately 300 nm, whereby it is proven that atoms activated with the same reaction energy traverse the crystal lattice per recoil over several lattice planes.

The results moreover show a further effect with respect to the chemical bond of the activated atoms insofar as previously existing bonds are destroyed, and preferably different chemical bonds are created in the surroundings of the activation products that were created. This new teaching forms the basis of the invention.

The inventors developed further proof of the accuracy of their assumptions by analyzing a different element, which occurs frequently in irradiated graphite. This element is europium, which has two natural isotopes, these being $^{151}Eu$ with a content of 47.8% and $^{153}Eu$ with 52.2%. At 9200 barns for $^{151}Eu$ and 390 barns for $^{153}Eu$, both have extremely large neutron capture cross-sections. However, the difference is that the recoil energies during these activation processes are very different.

This shows that the formation of $^{152}Eu$ is associated with the emission of high-energy gamma quanta and significant recoil. This likewise leads to the departure from existing chemical bonds, while the recoil is relatively weak with $^{154}Eu$ because of the low-energy nature of the emitted gamma rays.

The generally accepted teaching from these observations is that the activation products can be present in different types of chemical bonds for activation processes with significant recoil energy, and thus can be separated from the base material in an isotope-specific manner. The inventors managed to do so experimentally for radiocarbon in the environment of natural carbon isotopes by the targeted corrosion of $^{14}C$. However, the accuracy of the assumption was also demonstrated for the europium isotopes 152 and 154 in that these isotopes react differently, for example by way of electrolysis or leaching, with various liquids.

This also applies to radionuclides that found their way into the waste matrix through other mechanisms, for example by way of adsorption from a contaminated ambient atmosphere or by way of diffusion of radionuclides. In these cases as well, the chemical or physical bonds of radionuclides can differ considerably from the bonds of the waste matrix or the corresponding identical isotopes that were created as a result of the activation processes.

However, it must be noted for all of these processes that radiation-induced phenomena (radiation damage, ionization, dissociations, and the like) take place during irradiation, which influence the chemical bonds in the crystal structure and in the pore system of the graphite. This was also demonstrated by the aforementioned implantation experiments, in which cyano compounds of carbon and nitrogen, such as those that are found in irradiated graphite, formed increasingly.

It can also be assumed that volatile compounds of radioactive isotopes accumulate in the closed pore system of the graphite, which can then be released when the pore system is opened, for example by way of corrosion or by way of grinding.

Overall, it must be noted that the findings developed by the inventors with regard to the change in the chemical bond of activation products in graphitic and other waste open up a range of options for chemically treating these activation products, or such that ended up in the waste by way of adsorption and/or diffusion, in a targeted manner, and thus remove these from the waste matrix basically in an isotope-specific manner. The invention relates to methods that are based on these options.

Specific Description

The subject matter of the invention will be described in more detail hereafter based on exemplary embodiments, without thereby limiting the subject matter of the invention.

Combination of $H_2O_2$ and $HNO_3$ as Corrosive Media

The treatment of graphitic waste with $H_2O_2/HNO_3$ is the technical implementation of a chemical digestion. This is an acid digestion having an oxidizing effect. During this digestion. $H_2O_2$ acts as the oxidizing agent for $^3H$, $^{14}C$ and $^{36}Cl$, wherein the radioactive isotopes are transferred to the liquid or gaseous phase. $HNO_3$ acts as the solvent for metallic radioisotopes such as $^{60}CO$, $^{90}Sr$ and $^{137}Cs$. The use of microwaves and the associated heating of the reaction batch increase the efficiency of the method.

$KNO_3$ as a Solid Corrosive Medium

The principle of treating graphitic waste with solids is the direct release of a reactive gas from the added solid during heating. At temperatures above 400° C., nascent oxygen is created during the solid matter reaction with $KNO_3$, wherein $KNO_3$ is converted into $KNO_2$. This nascent oxygen is then directly available for the selective oxidation of $^{14}C$. Different oxygen suppliers such as CuO are also suitable for this reaction. The advantage of using $KNO_3$ lies in the low price of this solid and in the ease with which the same can be removed from the reaction mixture by simply washing out. A conversion of $KNO_2$ back into $KNO_3$ is easily possible by treatment with $HNO_3$, so that the method can be run in a loop.

$Ca(OH)_2$ or $CaCO_3$ as Solid Corrosive Media

Reactive gases such as water vapor or carbon dioxide can likewise be obtained from solid by way of thermal decomposition. Calcium hydroxide (slaked lime, $Ca(OH)_2$) or calcium carbonate (limestone, $CaCO_3$) are suitable for this purpose. $Ca(OH)_2$ gives off water vapor at 500° C. and $CaCO_3$ gives off $CO_2$ at 900° C. The solids can be mixed with graphite powder or graphite granules and burned in a furnace in the absence of oxygen. This leads to a selective release of radiocarbon. If graphite is reacted with water vapor (water gas reaction), the reaction can be expedited with a potassium carbonate catalyst and the reaction temperature can be lowered from approximately 800 to 700° C. The potassium carbonate catalyst is mixed as a solid in contents of 2 to 4 mass percent with the graphite/calcium hydroxide mixture and is heated to 500 to 700° C. The selective reaction of $^{14}C$ takes place in this temperature range. The reaction mixture is then turned into a slurry with water and other additives so as to obtain a solid and inert waste produce by way of cementing. However, the resulting calcium oxide (quicklime, CaO) can also be separated from the decontaminated graphite by dissolution in hydrochloric acid, for example, so as to supply the purified graphite to further processing.

Metal Hydrides as Solid Corrosive Media

The treatment of graphitic waste with hydrogen can be carried out both with hydrogen gas and with hydrogen-releasing solids. The latter has the advantage that highly reactive hydrogen is created "in statu nascendi" during the release of hydrogen from solids, which not only lowers the reaction temperature, but also increases the selectivity with respect to radiocarbon. Metal hydrides, such as lithium aluminum hydride ($LiAlH_4$) or sodium borohydride ($NaBH_4$) are suitable as hydrogen-releasing solids. Both solids release hydrogen when heated to 125 or 500° C., respectively, wherein sodium borohydride reacts less strongly.

N-Chlorosuccinimide as Solid Corrosive Medium

Many metals form relatively highly volatile metal chlorides with chlorine. The thermal volatility of metal chlorides between 1000 and 2000° C. is also utilized for purifying raw graphite. Here, the same principle is used to release metallic radioisotopes such as $^{60}Co$, $^{90}Sr$ and $^{137}Cs$ from graphitic waste. The required chlorine is obtained from the thermal decomposition of N-chlorosuccinimide (decomposition temperature approximately 200° C.), for example. The advantage of the solid reaction is that the reaction batch can be homogeneously mixed and that N-chlorosuccinimide is relatively safe to handle as compared to elemental chlorine. In addition, N-chlorosuccinimide pyrolyzes with additional temperature increases, so that the graphite thus decontaminated remains virtually free of residue.

The work that resulted in this invention was funded in accordance with Grant Agreement no. 211333 as part of the Seventh Framework Programme of the European Atomic Agency Community [RP7/2007-2011].

The invention claimed is:

1. A method for at least partially decontaminating solid waste that is contaminated with at least one radionuclide, wherein waste having a matrix made of non-radioactive base material is selected, in which the radionuclide is embedded, wherein:

a) the waste is mixed, or brought in contact, with at least one corrosive medium, which is inert with respect to the base material before the activation energy is supplied, wherein at least one binary metal oxide, sulfate, nitrate, hyroxide, carbonate, hydride, halogen succinimide and/or a peroxide, an acid, a lye, a completing agent and/or an electrolyte, and/or another reagent that can be pyrolyzed and/or dehydrated is selected as the corrosive medium and then b) activation energy is supplied to the corrosive medium, so that hydrogen or hydrogen ions,
oxygen or oxygen ions, and/or
halogen or halogen ions, and/or
nitrate and/or sulfate ions, and/or
carbon dioxide, and/or
water vapor are formed from the corrosive medium, and as a result of these products thus formed:

c) at least a portion of the radionuclide present in the waste is converted into at least one gaseous reaction product or is dissolved.

2. The method according to claim 1, wherein the hydrogen, hydrogen ions, oxygen, oxygen ions, halogen, and/or halogen ions react in the nascent state with the radionuclide.

3. A method according to claim 1, wherein at least one radionuclide, with which the waste is contaminated, was formed by a nuclear reaction, and more particularly nuclear fission or neutron activation.

4. The method according to claim 3, wherein the nuclear reaction took place in the material of the waste.

5. A method according to claim 1, wherein waste is selected that contains a further isotope of the same element, in addition to the radionuclide.

6. A method according to claim 1, wherein porous waste is selected.

7. A method according to claim 1, wherein waste containing $^{12}C$ and/or $^{13}C$ is selected.

8. A method according to claim 1, wherein waste that is present in the form of solid pieces, granules or powder is selected.

9. A method according to claim 1, wherein a liquid corrosive medium is selected.

10. A method according to claim 1, wherein the activation energy is supplied in form of heat, UV rays, or gamma rays.

11. The method according to claim 10, wherein the heat is supplied by heating, irradiating with microwaves, or by an alternating magnetic field.

12. A method according to claim 1, wherein a temperature between 100 and 1100° C., preferably between 200 and 750° C., and still more preferably between 200 and 500° C., is selected.

13. A method according to claim 1, wherein the activation energy is supplied by applying a direct current or by an alternating magnetic field.

14. A method for decontaminating a $^{12}C/^{13}C$-containing porous solid waste, which is contaminated with the $^{14}C$ radionuclide, wherein $CO_2$ is applied as corrosive medium to the waste, so that at least a portion of the waste is reacted to form at least one gaseous reaction product, wherein the process temperature is selected so that the $^{14}C$ radionuclide is enriched in the reaction product over $^{12}C/^{13}C$.

15. The method according to claim 14, wherein $CO_2$ is separated from the reaction product by freezing out or by washing out with a lye.

16. The method according to claim 14, comprising carrying out the method in a rotating reaction vessel, in a mixer, or in a fluidized bed reactor.

17. A method according to claim 1, wherein additionally at least one further reactive medium is applied to the waste.

18. A method according to claim 1, wherein the reaction of carbon is stopped when the ratio of the reaction rates of $^{14}C$ to $^{12}C/^{13}C$ passes a predetermined threshold value.

19. A method according to claim 1, wherein graphite, reactor graphite, or carbon brick is selected as the waste.

20. The method according to claim 19, wherein atoms, molecules, or ions are intercalated between the crystal lattice planes of the graphite.

21. A method according to claim 1, wherein waste having a porosity of at least 5%, and preferably between 10 and 25%, is selected.

22. A method according to claim 1, wherein $^{14}C$ and/or a metallic radionuclide is converted into at least one gaseous reaction product or is dissolved.

23. A method according to claim 1, wherein a catalyst is loaded to the inner surfaces of the pore system in the waste, wherein the catalyst lowers the required activation energy for the reaction of the corrosive medium with the radionuclide.

24. A method according to claim 1, wherein the waste is annealed at temperatures above 1000° C., and preferably between 1300 and 1500° C., before the corrosive medium is added.

25. A method according to claim 1, wherein the waste is embedded in a geopolymer after withdrawing the reaction product or products.

26. A method according to claim 1, wherein at least a portion of the waste is reacted with zirconium to form zirconium carbide after withdrawing the reaction product or products.

27. The method according to claim 26, wherein at least a portion of the waste is reacted with zirconium alloy waste.

* * * * *